US011667463B2

(12) United States Patent
Zavaro

(10) Patent No.: US 11,667,463 B2
(45) Date of Patent: Jun. 6, 2023

(54) STRUCTURAL ELEMENTS AND ASSEMBLIES FOR CONSTRUCTION MATERIAL PACKAGING

(71) Applicant: Avraham Zavaro, Beer Yaakov (IL)

(72) Inventor: Avraham Zavaro, Beer Yaakov (IL)

( * ) Notice: Subject to any disclaimer, the term of this patent is extended or adjusted under 35 U.S.C. 154(b) by 65 days.

(21) Appl. No.: 15/900,815

(22) Filed: Feb. 21, 2018

(65) Prior Publication Data

US 2018/0237215 A1 Aug. 23, 2018

Related U.S. Application Data

(60) Provisional application No. 62/461,811, filed on Feb. 22, 2017.

(51) Int. Cl.

| | |
|---|---|
| ***B65D 85/62*** | (2006.01) |
| ***B65B 11/00*** | (2006.01) |
| ***B65D 85/30*** | (2006.01) |
| ***B65D 71/06*** | (2006.01) |
| ***B65D 71/04*** | (2006.01) |
| ***B65D 71/00*** | (2006.01) |
| ***B65D 19/00*** | (2006.01) |

(52) U.S. Cl.

CPC ..... *B65D 85/62* (2013.01); *B65B 11/00* (2013.01); *B65D 19/00* (2013.01); *B65D 71/0092* (2013.01); *B65D 71/04* (2013.01); *B65D 71/06* (2013.01); *B65D 85/30* (2013.01); *B65D 2571/00018* (2013.01); *B65D 2571/00086* (2013.01)

(58) Field of Classification Search

CPC ..... B65D 85/62; B65D 71/0088; B65D 71/0092; B65D 71/0096; B65D 71/04; B65D 71/06; B65D 19/18; B65D 45/345; B65D 2571/00117; B65D 2571/00037; B65D 2571/00018; B65D 2571/0008; B65D 2571/00086; B65D 19/0095; B65D 19/0097; B65D 19/44; A61J 7/02

USPC ..... 206/451, 599, 386; 108/56.3

See application file for complete search history.

(56) References Cited

U.S. PATENT DOCUMENTS 2,614,689 A * 10/1952 Miller ..... B65D 71/0096 206/451

3,917,066 A 11/1975 Cloyd 5,320,048 A * 6/1994 Feiner ..... B65D 19/0016 108/51.11

(Continued)

FOREIGN PATENT DOCUMENTS

DE 102011052958 11/2012

OTHER PUBLICATIONS

Supplementary European Search Report and the European Search Opinion dated Mar. 30, 2021 From the European Patent Office Re. Application No. 118757384.5. (7 Pages).

*Primary Examiner* — Robert Poon

(57) ABSTRACT

Disclosed is stack support assembly. The stack support assembly includes at least one binding element to press and bind at least one support leg to a material stack; and at least one elongated and partially hollow support leg composed of a shaped polymer. The elongated and partially hollow support leg includes vertically oriented side walls connected to one another with a repeating pattern of interconnect structures, thereby forming hollowed channels extending between a top plane and a bottom plane of the support leg.

16 Claims, 12 Drawing Sheets

Load-bearing Element

(56) References Cited

U.S. PATENT DOCUMENTS

| | | | | |
|---|---|---|---|---|
| 6,539,880 | B2 * | 4/2003 | Simms | B65D 19/0012 108/51.3 |
| 7,025,208 | B2 * | 4/2006 | Baker | B65D 19/0026 206/386 |
| 9,126,753 | B2 * | 9/2015 | Cowie | B65D 90/18 |
| 2003/0177958 | A1 * | 9/2003 | Adams | B65D 71/0092 108/56.3 |
| 2008/0066657 | A1 * | 3/2008 | Kuo | B65D 19/0095 108/57.19 |
| 2015/0274358 | A1 * | 10/2015 | Hidalgo | B65D 19/0097 108/56.3 |

* cited by examiner

STRUCTURAL ELEMENTS AND ASSEMBLIES FOR CONSTRUCTION MATERIAL PACKAGING

RELATED APPLICATIONS

This application claims the priority of applicant's U.S. Provisional Patent Application No. 62/461,811, filed Feb. 22, 2017. The disclosure of the above mentioned Ser. No. 62/461,811, Provisional patent application, is hereby incorporated by reference in its entirety for all purposes.

FIELD OF THE INVENTION

The present invention generally relates to the field of packaging. More specifically, the present invention relates to structural elements and assemblies for construction material packaging, optionally by an automatic or semi-automatic packaging machine for boards, panels, platters and/or sheets.

BACKGROUND

Construction and building materials such as sheetrock, plasterboard and/or gypsum boards, although lighter than traditional construction materials such as brick, mortar, stone and concrete, these construction materials still impose a considerable transportation and storage burden between the factory and the construction sites where they are used. These construction materials, when packaged into large stacks or bundles, can weigh several tons and need to be kept dry during transportation and storage. Additionally, due to the already heavy weight contributed by the construction material itself, packaging weight needs to be kept down to a minimum while providing a very high load-bearing capacity and moisture resistance. These construction materials, are often packaged into stacks or bundles by use of automatic or semi-automatic wrapping machines.

Accordingly, there is a need in the field of construction material packaging, mobilization and transportation for structural elements and assemblies having improved load-bearing capacity and/or moisture resistance.

SUMMARY OF THE INVENTION

The present invention includes structural elements and assemblies for construction material packaging. According to embodiments of the present invention, there may be provided a composite load-bearing element for construction material, such as, but not limited to: sheetrock, plasterboard, wood, corrugated boards and/or plastics boards, which composite element may be in the form of a leg or bar and may be substantially hollow. According to embodiments, there may be provided a construction material packaging support leg or bar with two side walls connected to one another by a series of crossing structural supports, perpendicular, diagonal and/or tangential to the side walls.

The load-bearing element may, in accordance with some embodiments, be elongated and partially hollow and may be composed of a shaped polymer. The elongated load-bearing element may include substantially vertically oriented side walls connected to one another with a repeating pattern of interconnect structures or walls, thereby forming hollowed channels/spaces/cavities extending between a top plane and a bottom plane of load-bearing element.

According to some embodiments, the elongated load-bearing element may include: a substantially horizontally oriented bottom/base/floor surface stretching over the area of its bottom plane; a substantially horizontally oriented top/roof surface stretching over the area of its top plane; and/or both. The bottom surface may be connected: substantially perpendicularly to the bottom edge of each of the side walls; to the bottom edge of each of two edge walls of the elongated load-bearing element; and/or substantially perpendicularly to the bottom edges of at least some of the interconnect structures or walls. The top surface may be connected: substantially perpendicularly to the top edge of each of the side walls, to the top edge of each of the edge walls and/or substantially perpendicularly to the top edges of at least some of the interconnect structures or walls.

According to some embodiments, the elongated load-bearing element edge walls, may be located at each of the tips of its elongated shape, wherein the edge walls interconnect between the side walls and at least one of the planes (e.g. the bottom plane) of the load-bearing element. The edge walls of the elongated load-bearing element may each be: substantially perpendicularly oriented in relation to the top plane and the bottom plane of the load-bearing element; diagonally-oriented/sloped in relation to the top plane and the bottom plane; and/or partially vertically oriented and partially diagonally-oriented/sloped. The edge walls may be substantially perpendicularly oriented in relation to the side walls of the elongated load-bearing element.

According to some embodiments, several load-bearing elements or legs may be interconnected with each other, for example by one or more binding elements pressing and binding each of the support legs to their supported stack, while optionally also binding the stacked objects to each other, to collectively form a stack load-bearing/support assembly. According to some embodiments, the binding elements may, for example, take the form of: (a) plastic or metal straps; (b) ropes; (c) wires or cables; and/or (d) a shrinkable/stretchable/adhesive plastic/nylon/paper sheet or strap(s) thereof.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
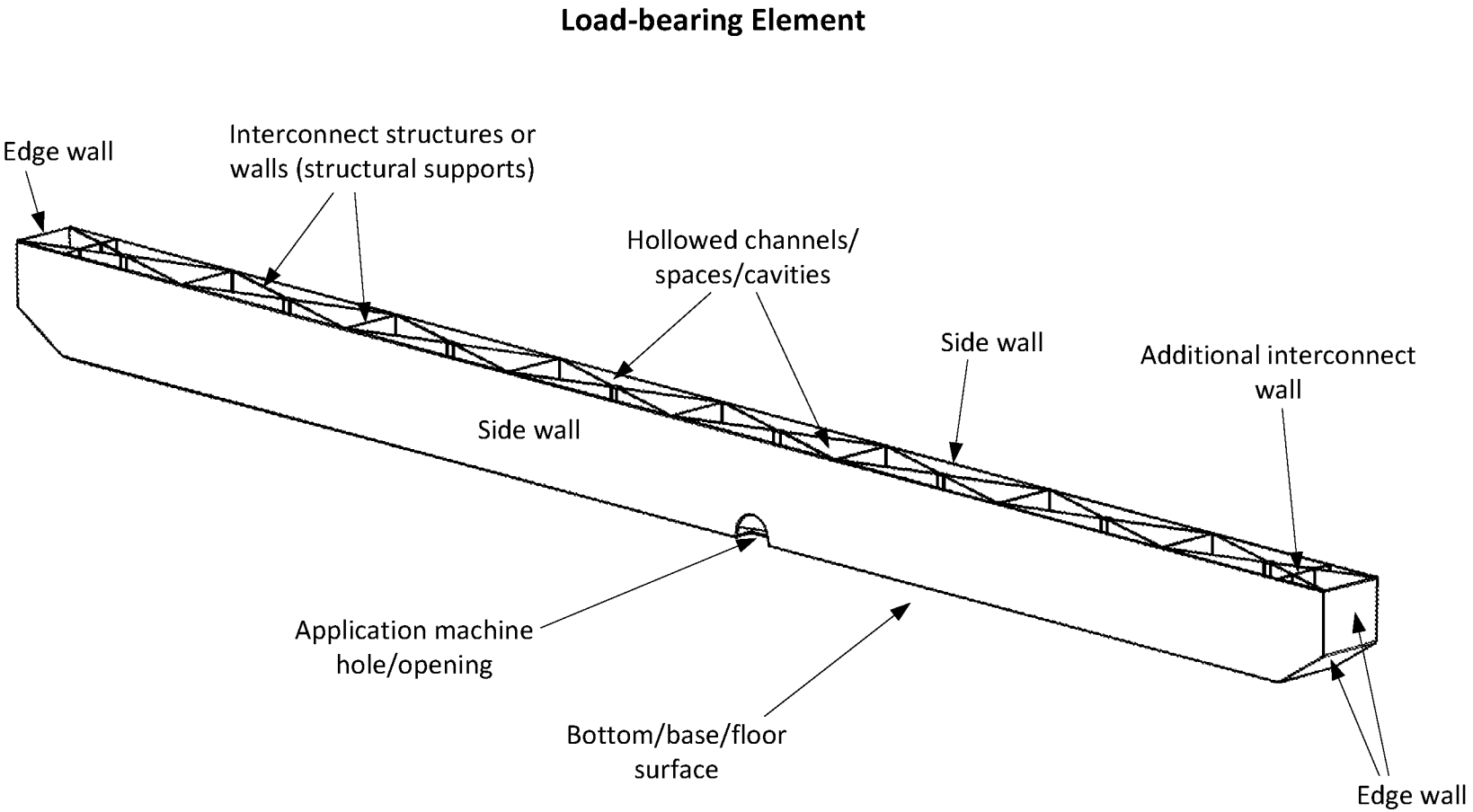
FIG. 1A shows a top perspective view of an exemplary load-bearing element (support leg), in accordance with some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Embodiments of the present invention may include apparatuses for performing the operations herein. This apparatus may be specially constructed for the desired purposes, or it may comprise a general purpose apparatus selectively applicable or configurable for the desired purposes.

The processes and displays presented herein are not inherently related to any particular apparatus, element, component, or assembly. Various general purpose embodiments may be used with in accordance with the teachings herein, or it may prove convenient to construct a more specialized embodiment to perform the desired method. The desired structure for a variety of these embodiments will appear from the description below. In addition, embodiments of the present invention are not described with reference to any particular packaged items or objects. It will be appreciated that a variety of items or objects may be packaged by implementing the teachings of the invention as described herein.

Throughout the specification, discussions utilizing terms such as "Leg", "Support Leg", "Support Element", "Load-bearing Element", or the like, may refer to any form of a supporting component used for supporting construction, or other, materials and/or stacks thereof, as part of their packaging. Furthermore, discussions utilizing terms such as "Binding Element", "Binder", "Binding Sheet", or the like, may refer to any form of a tying component used for fastening or securing one or more support legs to construction materials and/or stacks thereof, as part of their packaging.

Functions, operations, components and/or features described herein with reference to one or more embodiments, may be combined with, or may be utilized in combination with, any one or more other functions, operations, components and/or features described herein with reference to one or more other embodiments.

The present invention includes structural elements and assemblies for construction material packaging. According to embodiments of the present invention, there may be provided a composite load-bearing element for construction material, such as sheetrock and plasterboard, which composite element may be in the form of a leg or bar and may be substantially hollow. According to embodiments, there may be provided a construction material packaging support leg or bar with two side walls connected to one another by a series of crossing structural supports, perpendicular, diagonal and/or tangential to the side walls.

The load-bearing element may, in accordance with some embodiments, be elongated and partially hollow and may be composed of a shaped polymer. The elongated load-bearing element may include substantially vertically oriented side walls connected to one another with a repeating pattern of interconnect structures or walls, thereby forming hollowed channels/spaces/cavities extending between a top plane and a bottom plane of load-bearing element.

According to some embodiments, the elongated load-bearing element may include: a substantially horizontally oriented bottom/base/floor surface stretching over the area of its bottom plane; a substantially horizontally oriented top/roof surface stretching over the area of its top plane; and/or both. The bottom surface may be connected: substantially perpendicularly to the bottom edge of each of the side walls; to the bottom edge of each of two edge walls of the elongated load-bearing element; and/or substantially perpendicularly to the bottom edges of at least some of the interconnect structures or walls. The top surface may be connected: substantially perpendicularly to the top edge of each of the side walls, to the top edge of each of the edge walls and/or substantially perpendicularly to the top edges of at least some of the interconnect structures or walls.

According to some embodiments, the elongated load-bearing element edge walls, may be located at each of the tips of its elongated shape, wherein the edge walls interconnect between the side walls and at least one of the planes (e.g. the bottom plane) of the load-bearing element. The edge walls of the elongated load-bearing element may each be: substantially perpendicularly oriented in relation to the top plane and the bottom plane of the load-bearing element; diagonally-oriented/sloped in relation to the top plane and the bottom plane; and/or partially vertically oriented and partially diagonally-oriented/sloped. The edge walls may be substantially perpendicularly oriented in relation to the side walls of the elongated load-bearing element.

According to some embodiments, one or more additional interconnect structures or walls may be positioned close to, or at the proximity of, the edges of the elongated load-bearing element; and may thus create a load-bearing element having a higher density of structures or walls at the edges of the load-bearing element, in relation to the density of structures or walls at its side/edges.

According to some embodiments, a load-bearing element may comprise an application machine hole/opening for enabling a stack packaging machine component to at least partially enter/penetrate into and grab/grasp/retain load-bearing elements, pulling/pushing and positioning them at the bottom of a construction material stack being packaged. The application machine hole/opening may be positioned at, or at the proximity of, the central/middle section of the load-bearing element, optionally at its lower/bottom area.

According to some embodiments, the top plane of a load-bearing element may include roofed/covered sections and unroofed/uncovered sections. According to some embodiments, the bottom plane of a load-bearing element may include based-having/floored sections and non-based/unfloored sections. According to some embodiments, the top plane of a load-bearing element may include intermittently roofed/covered sections and unroofed/uncovered sections. According to some embodiments, the bottom plane of a load-bearing element may include intermittently base-having/floored sections and non-based/unfloored sections. According to some embodiments, the bottom plane of a load-bearing element may include intermittently base-having/floored sections and non-based/unfloored sections, wherein base-having/floored sections are unroofed/uncovered and non-based/unfloored sections are roofed/covered.

According to some embodiments, a load-bearing element may include any combination of support structures/walls, oriented perpendicularly, diagonally and/or tangentially relative to the side walls of the load-bearing element.

In FIG. 1A there is shown a top perspective view of an exemplary load-bearing element (support leg). The shown load-bearing element includes two side walls connected to each other by the interconnect structures or walls, the edge walls and the bottom/base/floor surface. The interconnect structures or walls, create between: themselves, the edge walls and/or the side walls—triangular and trapezoid hollowed channels/spaces/cavities—running from the top plane of the load-bearing element to its bottom plane base/floor surface. The load-bearing element is shown to include additional interconnect walls around its tips in proximity to the edge walls.

Figure 1B:
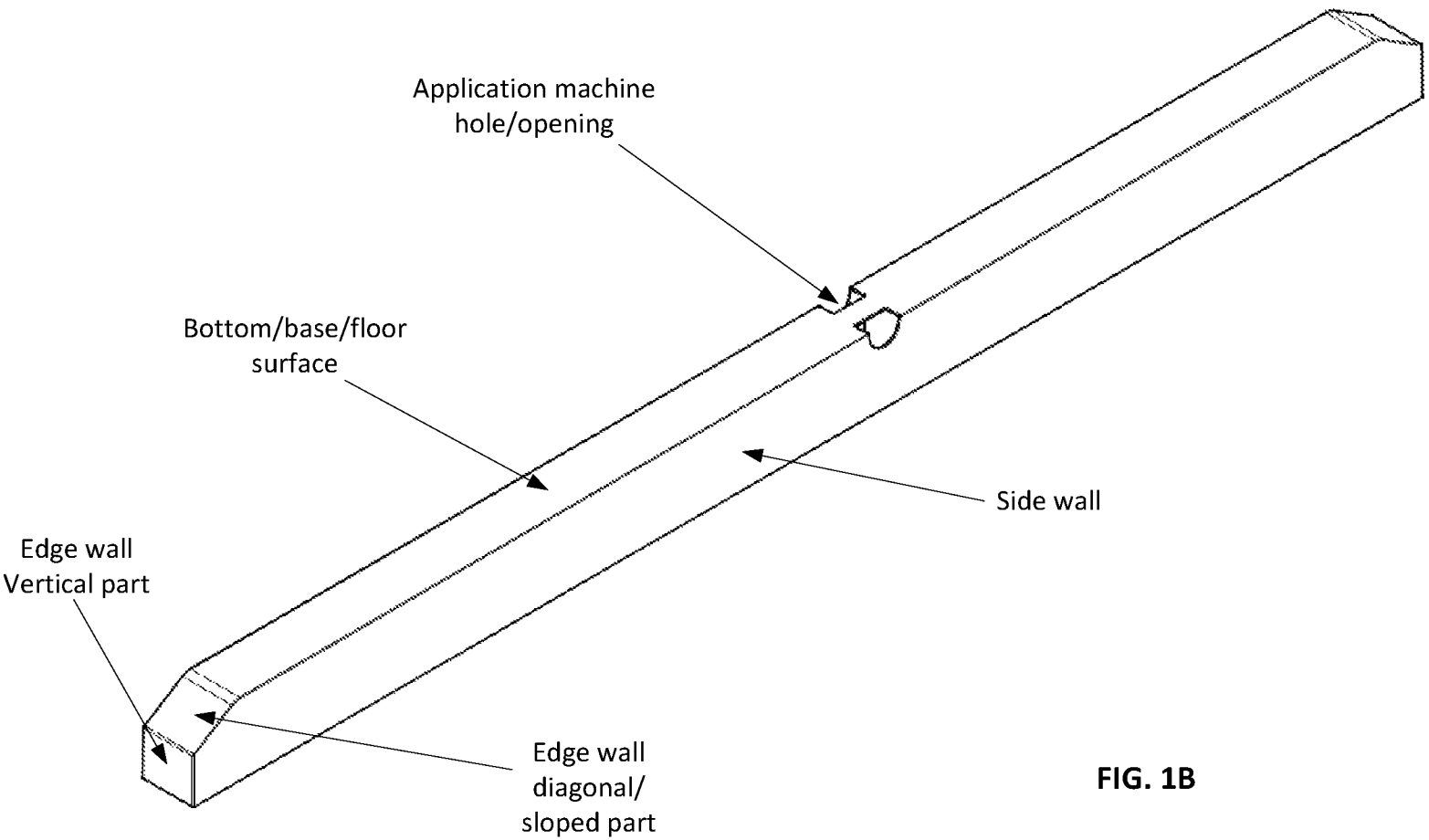
FIG. 1B shows a bottom perspective view of the exemplary load-bearing element (support leg) of FIG. 1A, in accordance with some embodiments of the present invention.

In FIG. 1B there is shown a bottom perspective view of the exemplary load-bearing element (support leg) of FIG. 1A. The bottom/base/floor surface of the load-bearing element is shown and the side wall connected thereto. Further shown are an application machine hole/opening and one of the edge walls shown to include a vertical part and a diagonal/sloped part.

Figure 1C:
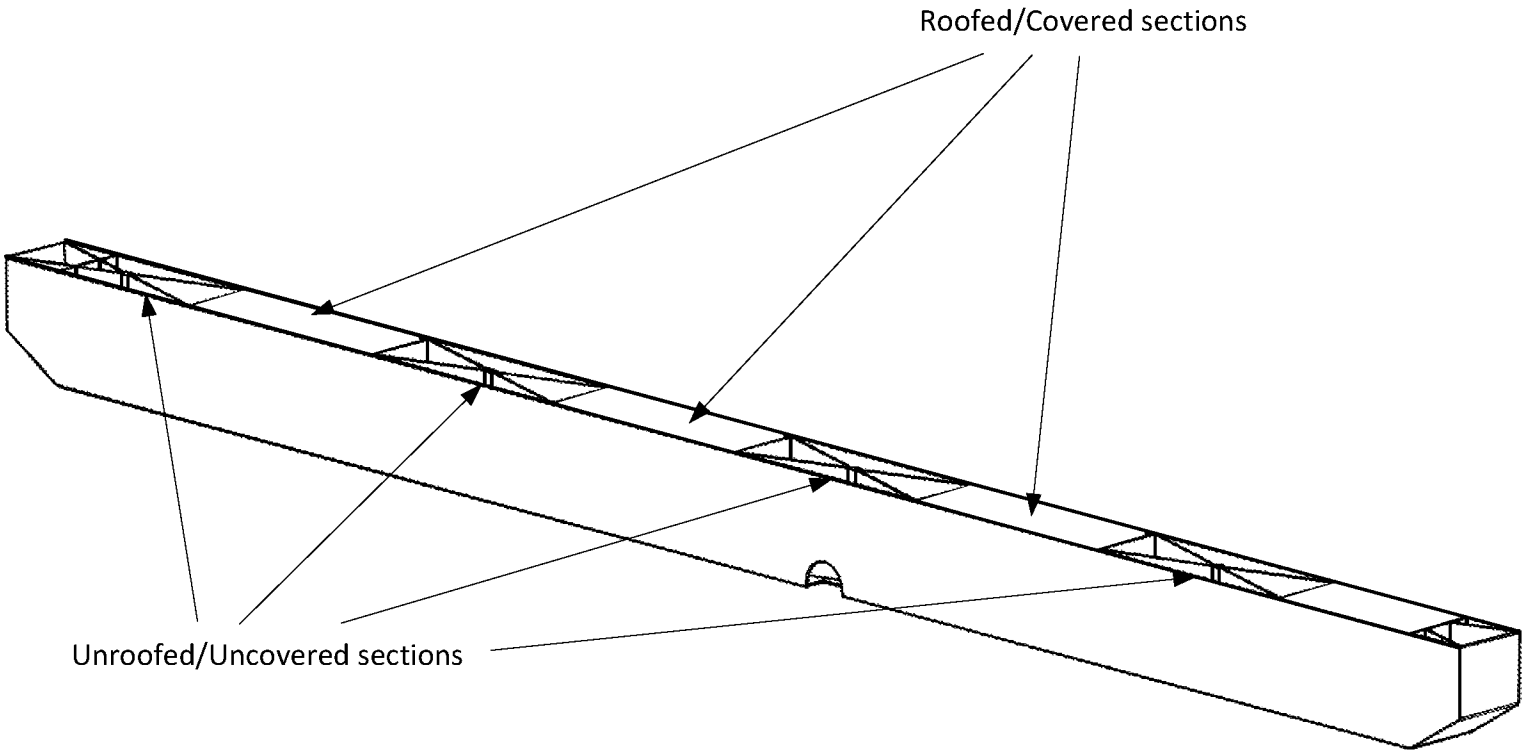
FIG. 1C shows a top perspective view of an exemplary load-bearing element (support leg), including intermittently covered (roofed) and uncovered (unroofed) sections, in accordance with some embodiments of the present invention.
Figure 1D:
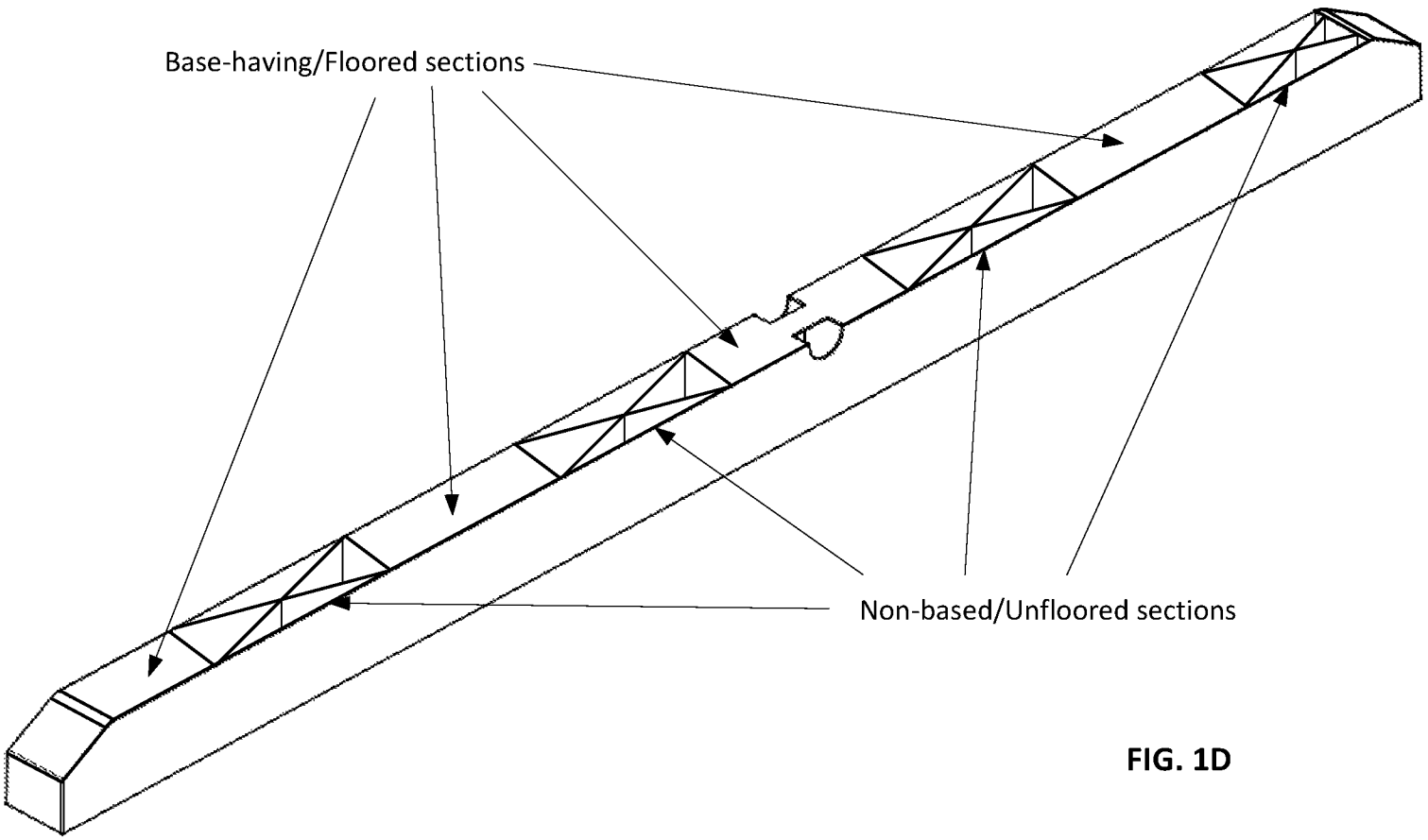
FIG. 1D shows a bottom perspective view of the exemplary load-bearing element (support leg) of FIG. 1C, including intermittently base having (floored) and non-based (unfloored) sections, wherein sections shown as base having (floored) are uncovered (unroofed) and sections shown as non-based (unfloored) are covered (roofed), in accordance with some embodiments of the present invention.
Figure 1E:
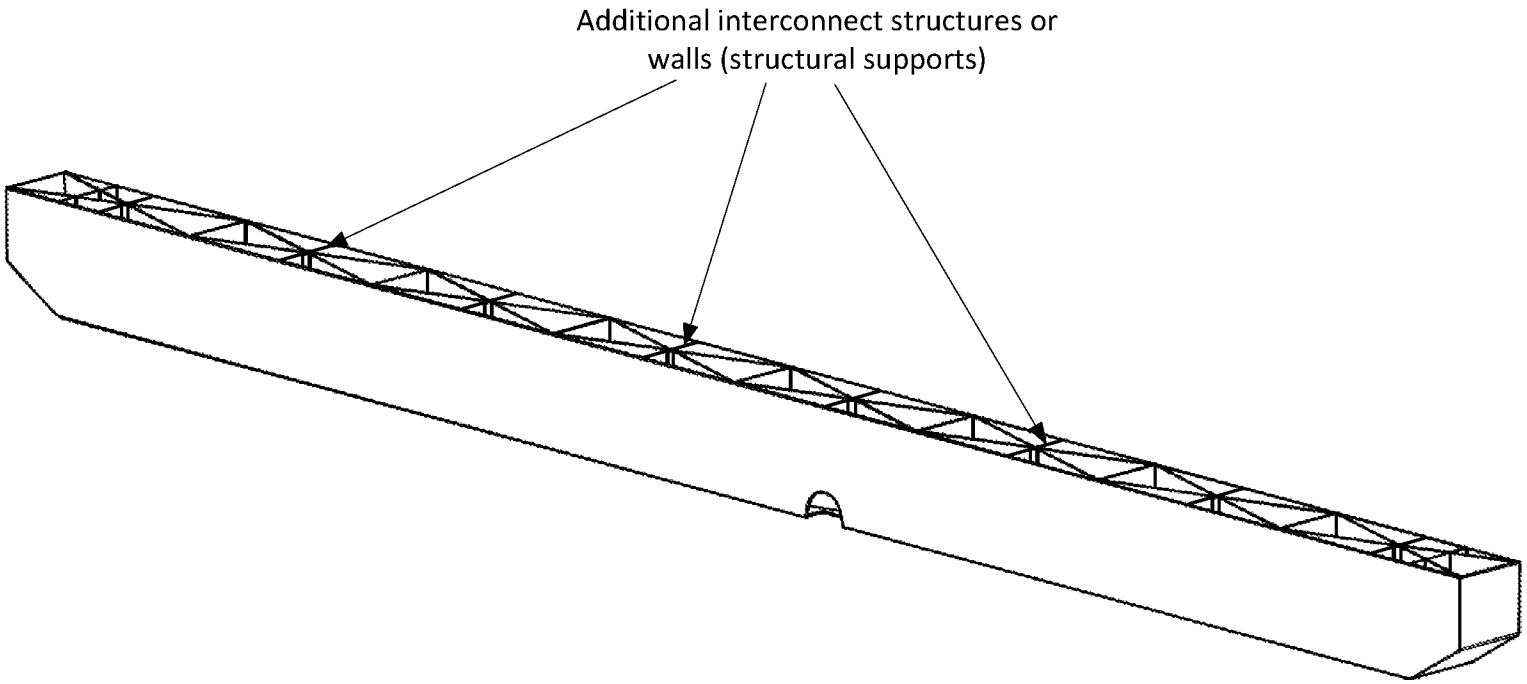
FIG. 1E shows a top perspective view of the exemplary load-bearing element (support leg) of FIG. 1A, including additional support structures, in accordance with some embodiments of the present invention.

In FIG. 1C there is shown a top perspective view of an exemplary load-bearing element (support leg), including intermittently covered (roofed) and uncovered (unroofed) sections, in accordance with some embodiments of the present invention;

In FIG. 1D there is shown a bottom perspective view of the exemplary load-bearing element (support leg) of FIG. 1C, including intermittently base having (floored) and non-based (unfloored) sections, wherein sections shown as base having (floored) are uncovered (unroofed) and sections shown as non-based (unfloored) are covered (roofed), in accordance with some embodiments of the present invention;

In FIG. 1E there is shown a top perspective view of the exemplary load-bearing element (support leg) of FIG. 1A, wherein the shown load-bearing element includes additional interconnect structures or walls. The additional interconnect structures or walls are perpendicular to the side walls and run across the meeting points of the diagonal interconnect structures or walls shown.

Figure 1F:
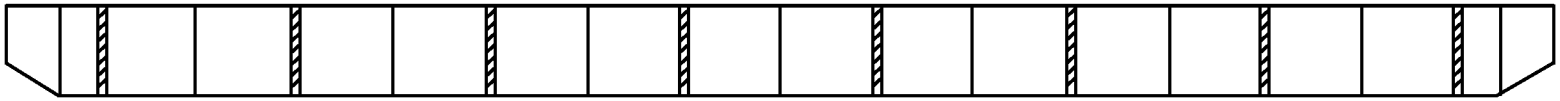
FIG. 1F shows a cross-section view along the exemplary load-bearing element (support leg) of FIG. 1A, in accordance with some embodiments of the present invention.

In FIG. 1F there is shown a cross-section view along the exemplary load-bearing element (support leg) of FIG. 1A.

Figure 1G:
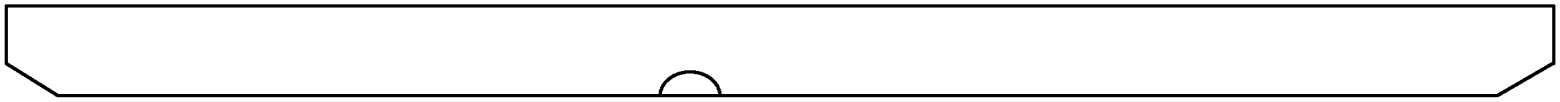
FIG. 1G shows a side view of the exemplary load-bearing element (support leg) of FIG. 1A, in accordance with some embodiments of the present invention.

In FIG. 1G there is shown a side view of the exemplary load-bearing element (support leg) of FIG. 1A.

Figure 1H:
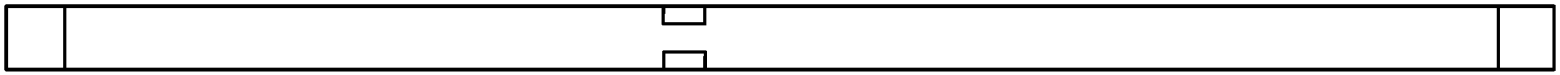
FIG. 1H shows a bottom view of the exemplary load-bearing element (support leg) of FIG. 1A, in accordance with some embodiments of the present invention.

In FIG. 1H there is shown a bottom view of the exemplary load-bearing element (support leg) of FIG. 1A.

Figure 1I:
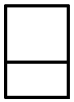
FIG. 1I shows a front view of the exemplary load-bearing element (support leg) of FIG. 1A in accordance with some embodiments of the present invention.

In FIG. 1I there is shown a front view of the exemplary load-bearing element (support leg) of FIG. 1A.

According to some embodiments, several load-bearing elements or legs may be arranged and collectively utilized to support a stack, or a packaged stack, of: (a) sheetrock; (b) drywall; (c) plasterboard; and/or (d) any other substantially flat boards, panels, platters and/or sheets.

Figure 2A:
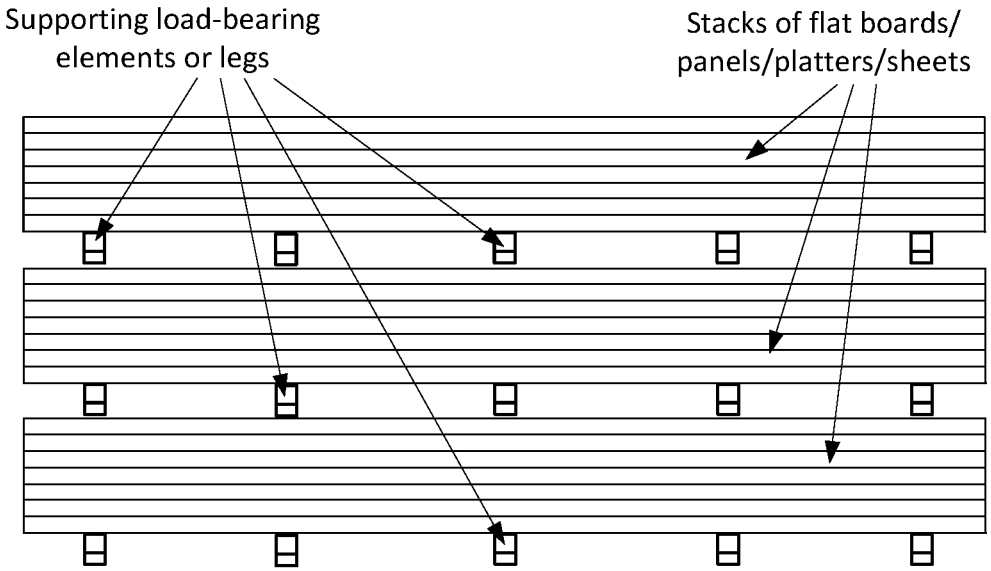
FIG. 2A shows a front view of a set of three supported stacks of flat boards/panels/platters/sheets, in accordance with some embodiments of the present invention.

In FIG. 2A there is shown a front view of a set of three stacks of flat boards/panels/platters/sheets, wherein each stack is supported by a corresponding set of five exemplary load-bearing elements/legs.

Figure 2B:
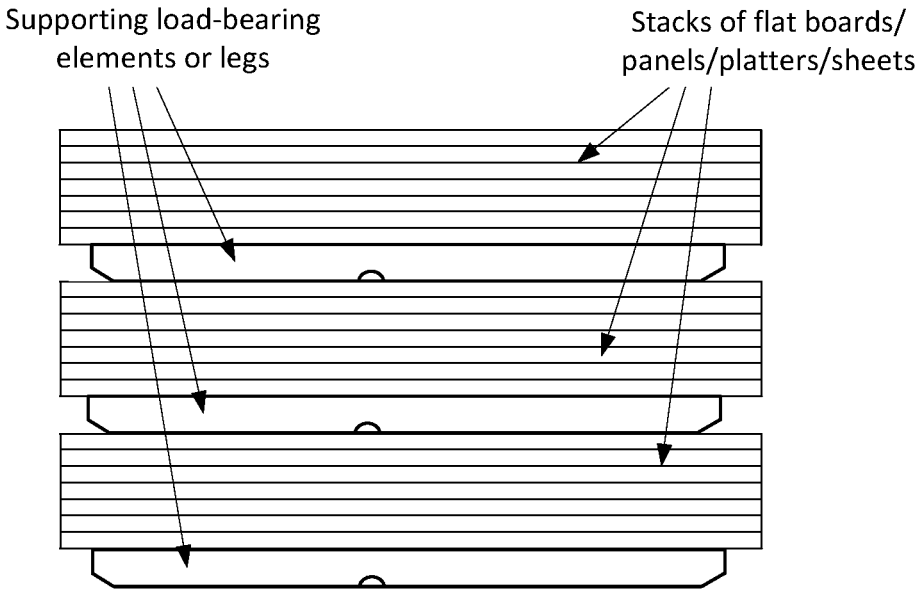
FIG. 2B shows a side view of a set of three supported stacks of flat boards/panels/platters/sheets, in accordance with some embodiments of the present invention.

In FIG. 2B there is shown a side view of a set of three stacks of flat boards/panels/platters/sheets, wherein each stack is supported by a corresponding set of exemplary load-bearing elements/legs.

According to some embodiments, several load-bearing elements or legs may be interconnected with each other, for example by one or more binding elements pressing and binding each of the support legs to their supported stack, while optionally also binding the stacked objects to each other, to collectively form a stack load-bearing/support assembly. According to some embodiments, the binding elements may, for example, take the form of: (a) plastic or metal straps; (b) ropes; (c) wires or cables; and/or (d) a shrinkable/stretchable/adhesive plastic/nylon/paper sheet or strap(s) thereof.

Figure 3A:
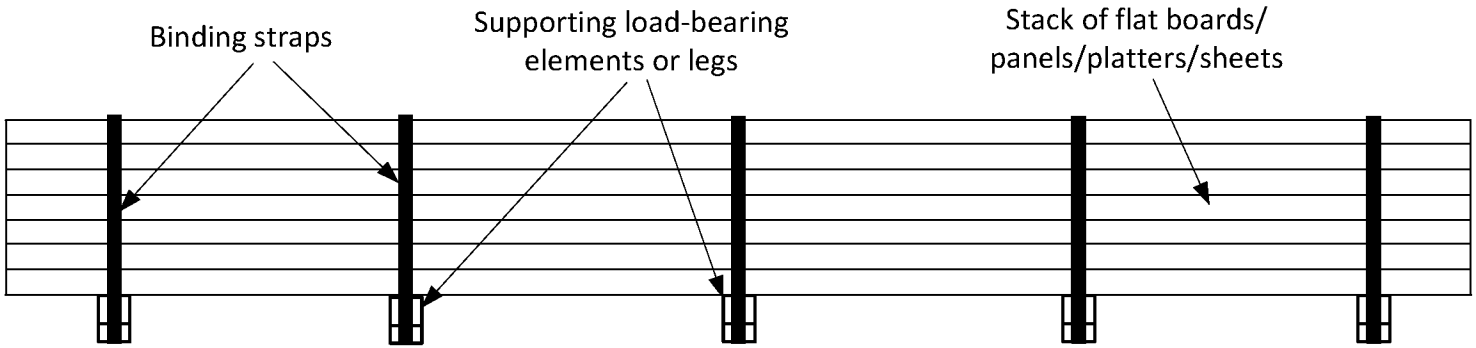
FIG. 3A shows a front view of a stack of flat boards/panels/platters/sheets, wherein the stack is supported by a set of five exemplary load-bearing elements/legs and binded by straps, in accordance with some embodiments of the present invention.

In FIG. 3A there is shown a front view of a stack of flat boards/panels/platters/sheets, wherein the stack is supported by a set of five exemplary load-bearing elements/legs and wherein each of the five load-bearing elements/legs is connected to the stack by a respective exemplary binding strap.

Figure 3B:
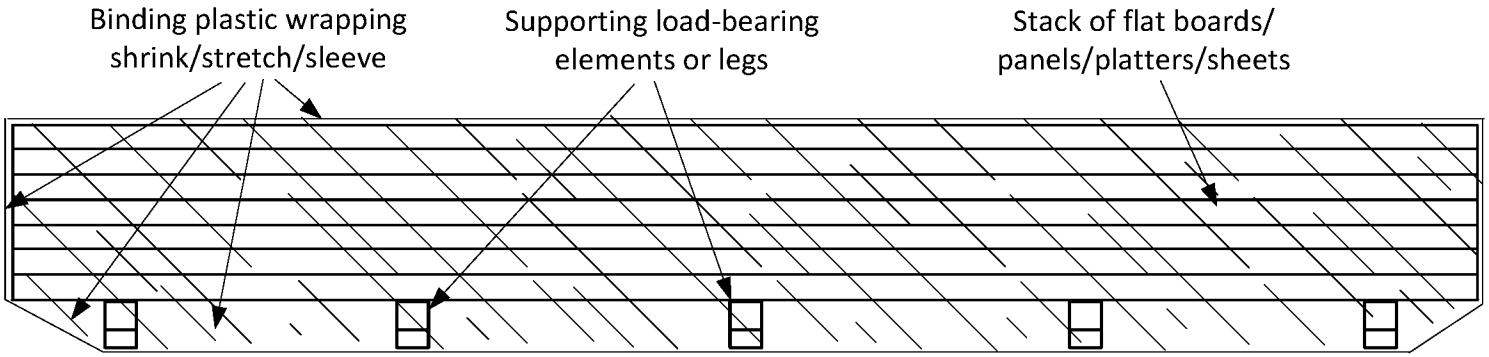
FIG. 3B shows a front view of a stack of flat boards/panels/platters/sheets, wherein the stack is supported by a set of five exemplary load-bearing elements/legs and binded by stretchable plastic, in accordance with some embodiments of the present invention.

In FIG. 3B there is shown a front view of a stack of flat boards/panels/platters/sheets, wherein the stack is supported by a set of five exemplary load-bearing elements/legs and wherein the five load-bearing elements/legs are collectively connected to the stack by an exemplary binding sticky/stretchable/wrapping plastic sheet.

A load-bearing element, in accordance with some embodiments, may comprise a strap groove or a strap channel for accepting and/or retaining a strap/rope/wire type binding element. The groove or channel may be located at, or substantially at, the bottom of, the two edge walls of the load-bearing element, optionally extending into its bottom/base/floor surface/plane. According to some embodiments, the strap groove may take the form of a channel, running from one edge wall of the load-bearing element, along its bottom/base/floor surface/plane, to its other (i.e. opposite side) edge wall.

Figure 4A:
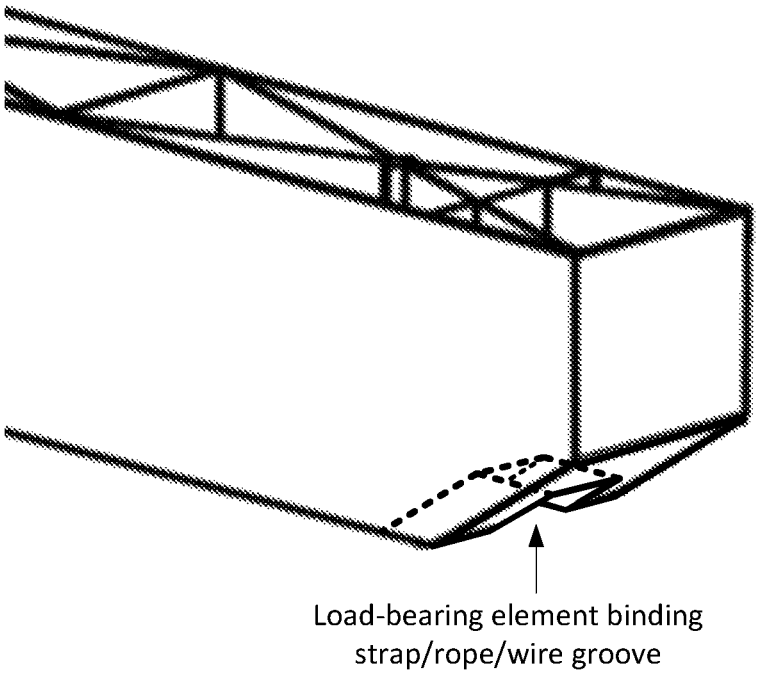
FIG. 4A shows a perspective view of a tip of an exemplary load-bearing element, wherein the tip includes a load-bearing element binding strap/rope/wire groove, in accordance with some embodiments of the present invention.

In FIG. 4A there is shown a perspective view of a tip of an exemplary load-bearing element, wherein the tip includes a load-bearing element binding strap/rope/wire groove. The groove includes an opening in the sloped part of the edge wall, connected to an opening on the edge of the floor of the load-bearing element. The load-bearing element may include a similar groove at its opposite tip.

Figure 4B:
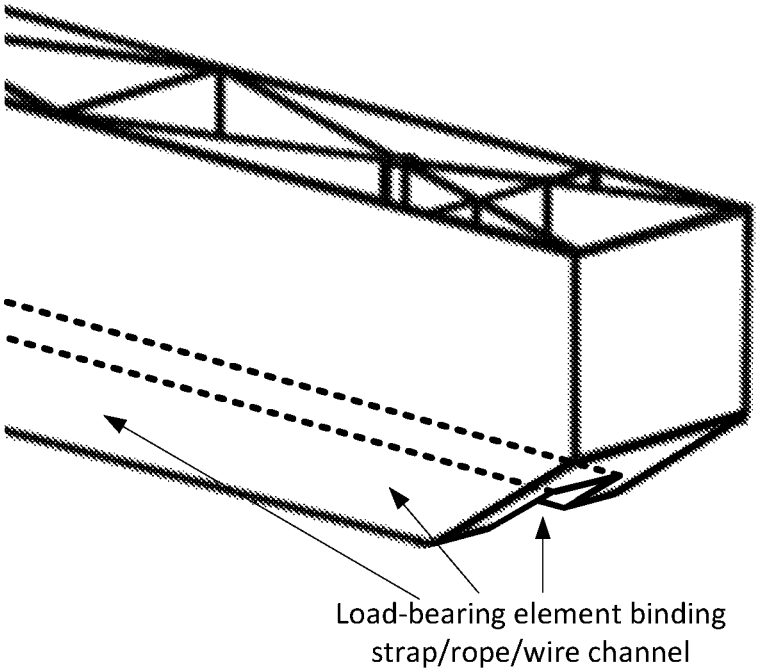
FIG. 4B shows a perspective view of a tip of an exemplary load-bearing element, wherein the tip includes a load-bearing element binding strap/rope/wire channel, in accordance with some embodiments of the present invention.

In FIG. 4B there is shown a perspective view of a tip of an exemplary load-bearing element, wherein the tip includes a load-bearing element binding strap/rope/wire channel. The channel includes an opening in the sloped part of the edge wall, connected to a channel running along the floor of the load-bearing element. The channel may run along the floor connecting to a similar opening in the sloped part of the edge wall at the opposite tip of the exemplary load-bearing element.

According to some embodiments, several load-bearing elements or legs may be interconnected with each other, for example by cross leg structures, to form a package load-bearing assembly. According to some embodiments, the cross leg structures may include one or more insertion elements each of which is adapted to detachably fit into at least one channel/space/cavity—formed between the two side walls and the series of crossing structural supports—of each of the load-bearing elements or legs crossed thereby. Two or more load-bearing elements or legs and two or more cross leg structures fitted into spaces/cavities thereof, may thus collectively form a package load-bearing assembly in the form of a support platform or surface. The package load-bearing assembly may be disassembled to its initial load-bearing elements or legs and cross leg structures components, by detaching/disconnecting the cross leg structures and/or insertion elements thereof from their hosting spaces/cavities within the load-bearing elements or legs.

According to some embodiments, a package load-bearing assembly may further include a top surface that may be positioned over and supported by its cross leg structures and optionally also supported by its load-bearing elements or legs. The resulting package load-bearing assembly may allow for the loading of any building materials, goods, equipment, boxes/packages and/or the like, over the top surface of the assembly. The top surface may be produced from any material or combination of materials such as, but not limited to: paper, cardboard, wood, plastic, polymer, metal, composite material(s) and/or the like.

Figure 5A:
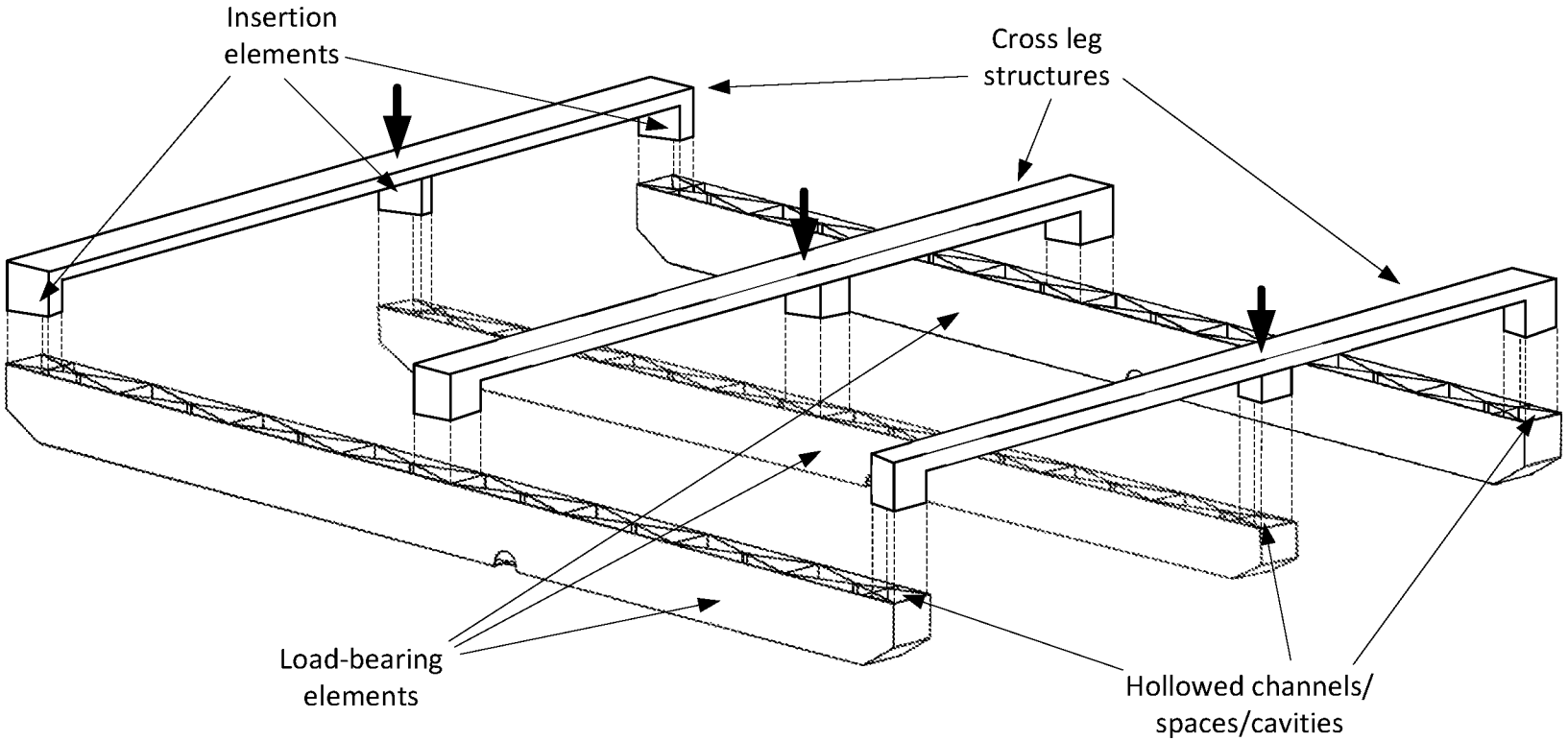
FIG. 5A shows a perspective view of three exemplary load-bearing elements or legs to be interconnected with each other, by three exemplary cross leg structures, to form a package load-bearing assembly, in accordance with some embodiments of the present invention.

In FIG. 5A there is shown a perspective view of three exemplary load-bearing elements or legs to be interconnected with each other, by three exemplary cross leg structures, to form a package load-bearing assembly. In the figure, the package load-bearing assembly is shown in a pre-connection state, wherein insertion elements of each of the cross leg structures are shown to be aligned with (by shown broken lines) and directed towards corresponding/matching hollowed channels/spaces/cavities in the shown load-bearing elements.

Figure 5B:
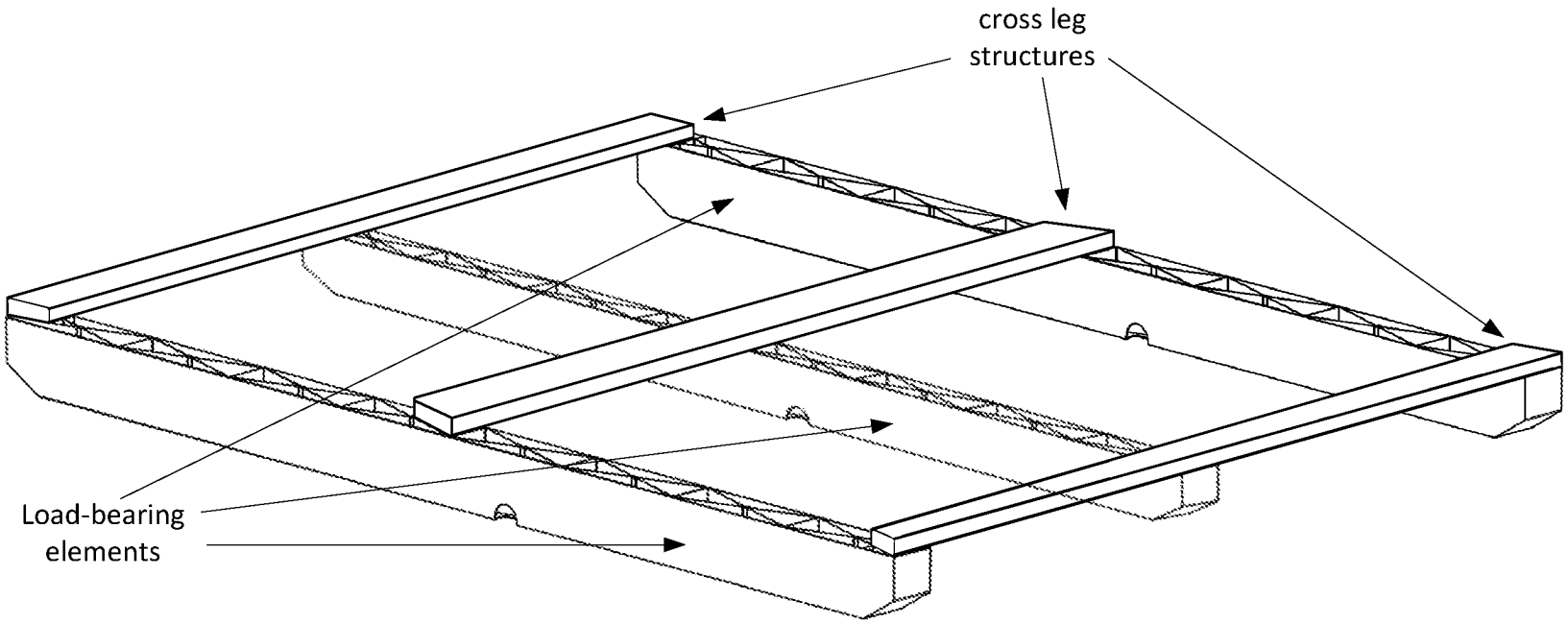
FIG. 5B shows a perspective view of three exemplary load-bearing elements or legs interconnected with each other, by three exemplary cross leg structures, to form a package load-bearing assembly, in accordance with some embodiments of the present invention.

In FIG. 5B there is shown a perspective view of three exemplary load-bearing elements or legs interconnected with each other, by three exemplary cross leg structures, to form a package load-bearing assembly. In the figure, the package load-bearing assembly is shown in a connected state, wherein insertion elements of each of the cross leg structures are shown to be inserted into and retained by their corresponding/matching hollowed channels/spaces/cavities in the shown load-bearing elements.

According to some embodiments, techniques similar to those shown in FIGS. 5A and 5B and described herein, may be utilized for the connection of any number of multiple (e.g. 2 or more) load-bearing elements to any number of multiple (e.g. 2 or more) cross leg structures—to form a package load-bearing assembly.

According to some embodiments, the load-bearing element may be produced of any material, or combination of materials, selected from the group consisting of: (a) EVOH—Ethylene vinyl alcohol; (b) ABS—Acrylonitrile butadiene styrene; (c) PMMA—Poly(methyl methacrylate)-Acrylic; (d) PTFE—Polytetrafluoroethylene (Teflon); (e) PU—Polyurethane; (f) PE—Polyethylene; (g) PEN—Polyethylene naphthalate; (h) PBT—Polybutylene terephthalate; (i) PPO—Polyphenylene Oxide; (j) PP—Polypropylene; (k) PBI—Polybenzimidazole; (l) PVDC—Polyvinylidene chloride; (m) PETG—Polyethylene terephthalate glycol; (n) PCTFE—Polychlorotrifluoroethylene; (o) POM—Polyoxymethylene-Acetal; (p) LCP—Liquid crystal polymers; (q) PA—Polyamide—Nylon; (r) PI—Polyimide; (s) PET—Polyethylene terephthalate; (t) PES—Sulfonated polyether; (u) PS—Polystyrene; (v) PPS—Polyphenylene sulfide; (w) PC—Polycarbonate; (x) PVDF—Polyvinylidene fluoride or polyvinylidene difluoride; (y) High-density polyethylene; (z1) Linear low-density polyethylene; and/or (z2) PVC—Polyvinyl chloride.

According to some embodiments, some or all of the material(s) the load-bearing element is produced of may be recycled plastic or any combination of recycled or partially recycled material(s).

According to some embodiments, the load-bearing element may be produced by any process suitable for the materials listed above, such as, but not limited to: (a) injection machines; (b) vacuum forming; and/or (c) blow molding.

According to some embodiments, the load-bearing element, or a set of load-bearing elements, may be used in different ways and combinations, such as, but not limited to: (a) legs for storage of gypsum boards; (b) legs for storing profiles or wooden panels or tubes; (c) legs combined with other plastic parts that make the legs to come apart; (d) legs combined with carton/cardboard that makes it into a plate of transport of goods; (e) in a warehouse to support goods, equipment, high weight; (f) wherein relatively shorter legs elements are used for packing machines such as washing machines, stoves, or any other heavy product or component wrapped in shrink, stretch, or similar; and/or (g) wherein extra parts for the legs can make the legs reusable, or for multiple uses depending on the type of product attached.

Figure 6:
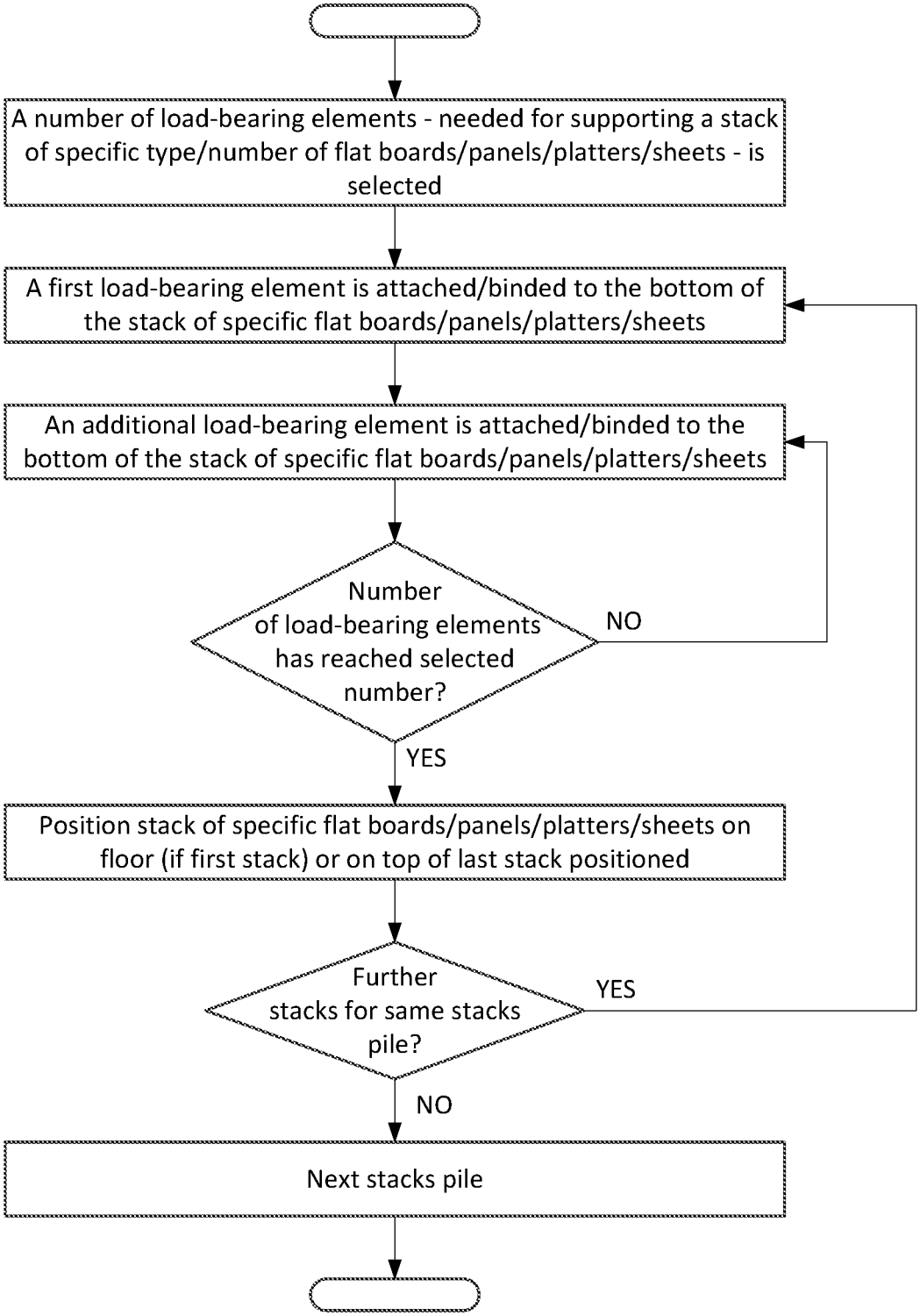
FIG. 6 is a flowchart showing the main steps executed as part of a process for construction, or other, material packaging, in accordance with embodiments of the present invention.

In FIG. 6 there is shown, a flowchart of the main steps executed as part of a process for construction, or other, material packaging, in accordance with embodiments of the present invention. The shown process includes the following steps: (a) a number of load-bearing elements—needed for supporting a stack of specific type/number of flat boards/ panels/platters/sheets—is selected; (b) a first load-bearing element is attached/binded to the bottom of the stack of specific flat boards/panels/platters/sheets; (c) an additional load-bearing element is attached/binded to the bottom of the stack of specific flat boards/panels/platters/sheets; (d) if the number of load-bearing elements has not reached the selected number, go back to (c); else, (e) position stack of specific flat boards/panels/platters/sheets on floor (if first stack) or on top of last stack positioned; (f) if further stacks for same stacks pile are to be added, go back to (b); else, (g) move to next stacks pile.

According to some embodiments of the present invention, a plasterboard stack support assembly may comprise at least one elongated and partially hollow support leg (also referred to as 'load-bearing element' herein) composed of a shaped polymer, wherein the elongated support includes vertically oriented side walls connected to one another with a repeating pattern of interconnect structures, thereby forming hollowed channels extending between a top plane and a bottom plane of the support leg.

According to some embodiments, the plasterboard stack support assembly may further comprise at least one binding element to press and bind at least one of the support legs to the plasterboard stack.

According to some embodiments, the interconnect structures, of the plasterboard stack support assembly, may run the full height of the walls from top to bottom plane of the support leg.

According to some embodiments, the walls and the interconnect structures, of the plasterboard stack support assembly, may both perform compressive load bearing of the supported plasterboard stack.

According to some embodiments, the repeating pattern of interconnect structures, of the plasterboard stack support assembly, may include elements oriented perpendicularly relative to the walls.

According to some embodiments, the repeating pattern of interconnect structures, of the plasterboard stack support assembly, may include elements oriented diagonally relative to the walls.

According to some embodiments, the repeating pattern of interconnect structures, of the plasterboard stack support assembly, may include elements oriented tangentially relative to the walls.

According to some embodiments, the binding element(s) may be a stretchable plastic/nylon sheet(s)/sleeve(s) and/or one or more strap(s).

According to some embodiments, the plasterboard stack support assembly may further comprise binding strap grooves at the tips of each of the elongated support legs, wherein the binding strap grooves of a given elongated support leg are adapted to accept and retain in its position a respective strap binding element.

According to some embodiments, the plasterboard stack support assembly may further comprise binding strap channel at the bottom of the elongated support legs, wherein the binding strap channel of a given elongated support leg is adapted to accept and retain in its position a respective strap binding element.

According to some embodiments, the thickness of at least the side walls and the interconnect structures, of the plasterboard stack support assembly, may be between 1 and 2 millimeters, for example, approximately 1.5 millimeters.

According to some embodiments, the weight of one of the elongated and partially hollow support legs, of the plasterboard stack support assembly, may be between 400 and 600 grams, for example, approximately 500 grams.

According to some embodiments, the plasterboard stack support assembly may further comprise edge walls at the tips of each of the elongated and partially hollow support legs. According to some embodiments, each of the edge walls may comprise a vertical part and a sloped part. According to some embodiments, each of the sloped parts may create an angle of less than 45 degrees, for example approximately 32 degrees, with the top plane of its respective support leg.

According to some embodiments, the sloped parts of the edge walls may cover less than 50 percent of the total vertical height of the edge walls and the vertical parts of the edge walls may cover more than 50 percent of the total vertical height of the edge walls.

According to some embodiments, the plasterboard stack support assembly may further comprise two or more cross leg structures, each of which includes one or more insertion elements adapted to detachably fit into at least one of the hollowed channels extending between the top plane and the bottom plane of the support legs—of each of two or more support legs crossed by the cross leg structures, wherein two or more of the support legs and two or more of the cross leg structures fitted into hollowed channels thereof, collectively form a package load-bearing assembly in the form of a support platform or surface.

According to some embodiments of the present invention, a system for flat material stack supporting may comprise: two or more sets, each including at least one elongated and partially hollow support leg composed of a shaped polymer, wherein the elongated support legs include vertically oriented side walls connected to one another with a repeating pattern of interconnect structures, thereby forming hollowed channels extending between a top plane and a bottom plane of the support leg; at least one binding element to press and bind at least one of the support legs to the material stack; wherein elongated and partially hollow support legs found within different sets of the two or more sets, are of a different size or size range and are differently designated, for example by a visible sign/marking and/or by their color.

According to some embodiments of the present invention, a method for flat material stack supporting may include: selecting a number of load-bearing elements—needed for supporting a stack of specific type/number of flat boards/panels/platters/sheets; binding a first load-bearing element to the bottom of the stack; binding additional load-bearing elements to the bottom of the stack until the selected number load-bearing elements is reached; positioning the stack on the floor, if a first stack, or on top of the last stack positioned; repeating until a predetermined number of stacks are piled over each other; and repeating for piling of remaining stacks.

The subject matter described above is provided by way of illustration only and should not be constructed as limiting. While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. A plasterboard stack support assembly comprising at least one elongated and partially hollow support leg composed of a shaped polymer, wherein said support leg includes:

external walls comprising two opposing side walls extending vertically from a base surface, and two edge walls having a sloped part extending from the base surface to a vertical part extending to a top surface of the support, the support being opened at the top;

said two side walls having a vertical height defined by a distance between the base surface and the top surface along a vertical direction perpendicular to the base surface and top surface;

said base surface and said top surface having a horizontal width defined by a distance between outer sides of the side walls along a horizontal direction perpendicular to the side walls;

wherein said two side walls are connected to one another with intersecting interior walls defining a plurality of intersecting x-shaped vertical structures arranged along a longitudinal direction extending between the end walls;

wherein said vertical height is greater than said horizontal width; and wherein surfaces of the intersecting interior walls are oriented along the vertical direction and also oriented diagonally relative to the side walls to form hollowed channels extending along the vertical direction and within said support leg, and the intersecting interior walls are sized, positioned and oriented so that the external walls and the intersecting interior walls of the x-shaped vertical structures both perform compressive load bearing when supporting a plasterboard stack.

2. The plasterboard stack support assembly of claim 1, further comprising at least one binding element to press and bind at least one of said support legs to a plasterboard stack.

3. The plasterboard stack support assembly of claim 1, comprising interior walls oriented perpendicularly relative to said side walls.

4. The plasterboard stack support assembly of claim 1, comprising interior walls oriented tangentially relative to said side walls.

5. The plasterboard stack support assembly of claim 2, wherein said at least one binding element comprises a stretchable plastic/nylon sheet.

6. The plasterboard stack support assembly of claim 2, wherein said at least one binding element comprises plastic straps.

7. The plasterboard stack support assembly of claim 6, further comprising binding strap grooves on tips of each of said at least one elongated support legs, each said binding strap grooves being adapted to accept and retain in its position a respective plastic strap binding element.

8. The plasterboard stack support assembly of claim 6, further comprising a respective binding strap channel at the bottom of each of said at least one elongated support legs, wherein said binding strap channel is adapted to accept and retain in its position a respective plastic strap binding element.

9. The plasterboard stack support assembly of claim 1, wherein a thickness of at least said side walls and said x-shaped vertical structures is between 1 and 2 millimeters.

10. The plasterboard stack support assembly of claim 1, wherein the weight of one of said at least one elongated and partially hollow support legs is between 400 and 600 grams.

11. The plasterboard stack support assembly of claim 1, further comprising two or more cross leg structures, each of which includes one or more insertion elements adapted to detachably fit into at least one of the hollowed channels, wherein two or more of said at least one support legs and two or more of said cross leg structures fitted into hollowed channels thereof, collectively form a package load-bearing assembly in a form of a support platform or surface.

12. The plasterboard stack support assembly of claim 1, wherein the base surface is also the lowest surface of the overall support assembly.

13. The plasterboard stack support assembly of claim 12, wherein the hollowed channels defined by the intersecting interior walls are open to the opened top of the support leg.

14. The plasterboard stack support assembly of claim 1, wherein the top surface is also the top-most surface of the overall support assembly.

15. The plasterboard stack support assembly of claim 1, wherein the vertical height of the overall support assembly is the vertical height of the side walls.

16. The plasterboard stack support assembly of claim 1, comprising:

an upper stack of plasterboards;

a lower stack of plasterboards; and a plurality of said support legs;

wherein each of the plurality of support legs is:

positioned vertically between the upper and lower stacks of plasterboards, vertically oriented with the base surface toward the lower stack of plasterboards and the top surface toward the upper stack of plasterboards; and wherein the external walls and the intersecting interior walls of the x-shaped vertical structures both receive a compressive load exerted along their surface, and between the upper and lower stacks of plasterboards.

* * * * *